US006073378A

United States Patent [19]

Gabbert

[11] Patent Number: 6,073,378

[45] Date of Patent: Jun. 13, 2000

[54] REUSABLE, WEATHER-PROOF COVER FOR TEMPORARY SIGNS

[76] Inventor: Gail Gabbert, 628 Asbury St., Evanston, Ill. 60201

[21] Appl. No.: 09/197,556

[22] Filed: Nov. 23, 1998

[51] Int. Cl.[7] ..... G09F 3/20; G09F 3/18

[52] U.S. Cl. ..... 40/661; 40/653; 40/664; 40/649; 40/651; 40/654.01; 40/776

[58] Field of Search ..... 40/673, 661, 653, 40/664, 655, 649, 651, 654.01, 537, 765, 776, 617; 24/587; 292/300

[56] References Cited

U.S. PATENT DOCUMENTS

| | | | |
|---|---|---|---|
| 1,761,995 | 6/1930 | Siebe | 40/651 |
| 5,149,571 | 9/1992 | Croell | 40/661 X |
| 5,159,964 | 11/1992 | Baker et al. | 150/147 |
| 5,193,852 | 3/1993 | Bachmeyer | 40/654.01 X |
| 5,323,552 | 6/1994 | Fritz | 40/731 |
| 5,323,553 | 6/1994 | Candido | 40/537 |
| 5,388,739 | 2/1995 | Gargan | 40/661 X |
| 5,429,700 | 7/1995 | Hudson | 40/597 X |
| 5,628,566 | 5/1997 | Schreiter | 24/587 X |
| 5,761,839 | 6/1998 | Heikkila | 40/730 |
| 5,878,468 | 3/1999 | Tomic et al. | 24/587 X |

*Primary Examiner*—Terry Lee Melius
*Assistant Examiner*—Rodrigo J. Morales

[57] ABSTRACT

A transparent plastic envelope made up of a front panel and a back panel secured together by parallel sealing lines around the periphery, and a line of mounting holes between the lines for receiving a mounting tie. The back panel is made up of two sections to form an opening for insertion of a sign element into the envelope. A plastic sealing zipper is secured to the meeting edges of the two sections.

7 Claims, 2 Drawing Sheets

19
27
3
32
30
29
16
FRONT
4
4
18
29
5
31
28
3
5

REAR
32
30
22
6
6
18
31
16
43
44
7
7

24
20
EXAGG-
ERATED
22
35
36
26

16
20
31
18
22
32
30
EXAGGERATED 22
40
18
REAR
20
24
43
38
35
44
FRONT
42
32
31
26
30

REUSABLE, WEATHER-PROOF COVER FOR TEMPORARY SIGNS

FIELD OF THE INVENTION

The invention resides in the field of advertisements or announcements to be mounted in a specific location. Examples of such uses are where a house is for sale, and in the use of what are known as yard sales or garage sales, and still others such as no parking in certain instances.

Such ads in the form of mounted signs, may be of temporary use, or even permanent use, as desired.

SUMMARY OF THE INVENTION

The present invention has to do more particularly with a cover for an ad or sign that is mounted in a particular location of the overall character ref erred to above, having uses and advantages according to the following:

1. It is in the form of a sign, that is to be mounted in a particular location, and for a temporary period of time.

2. It is very inexpensive.

3. It is to be not only temporary, but reused, as many times as practical, and is therefore very simple and easy to mount.

4. The sign cover although made of inexpensive material is very attractive visually and is of long-lasting characteristics, and is easy to mount and dismount while preserving the attractive characteristics of the sign.

5. The sign includes a casing or envelope which is transparent, and a sign per se which is removably inserted in the envelope, and thus the envelope can be used for any of a variety of signs.

6. Another advantage is that the device can be mounted in any of various positions, such as relatively inverted or reversed.

7. The device can be easily mounted by means of a simple tie which enables it to be mounted on any of various items such as posts, fences, etc. already in place.

8. There are no special tools required for mounting the sign, it being only necessary to utilize a tie that is easily manipulable by the hands.

BRIEF DESCRIPTIONS OF THE FIGURES OF THE DRAWINGS

DETAILED DESCRIPTION OF THE DRAWINGS

Figure 1:
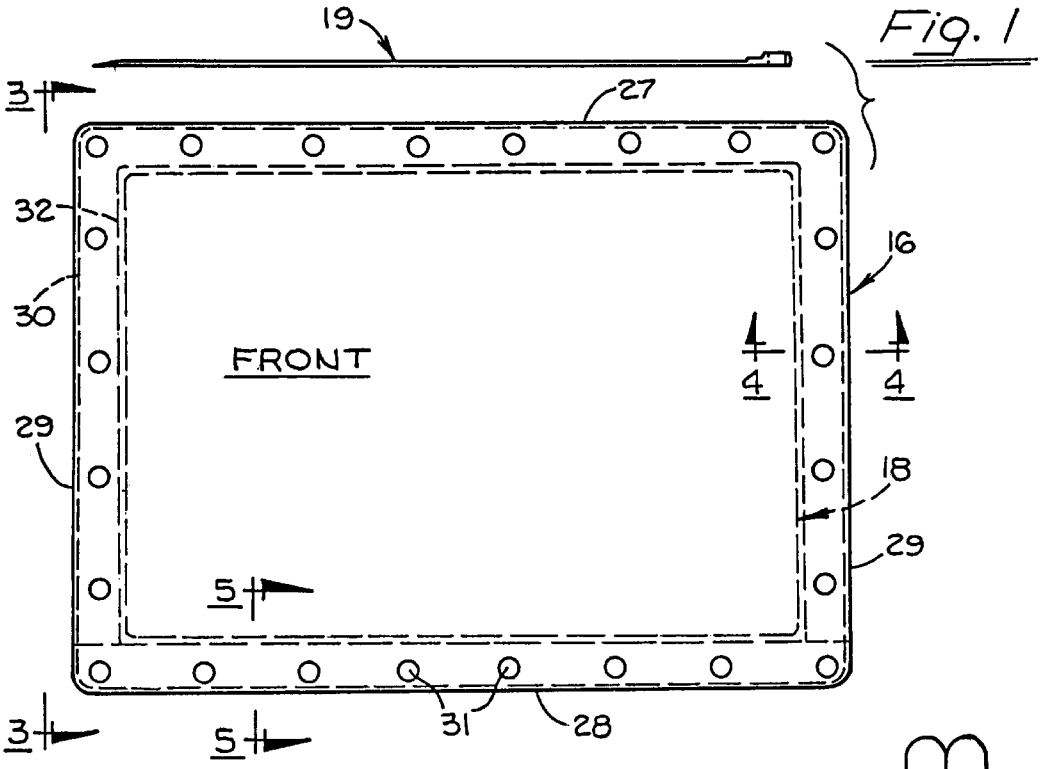
FIG. 1 is a face view of the front side of the device of the invention.
Figure 2:
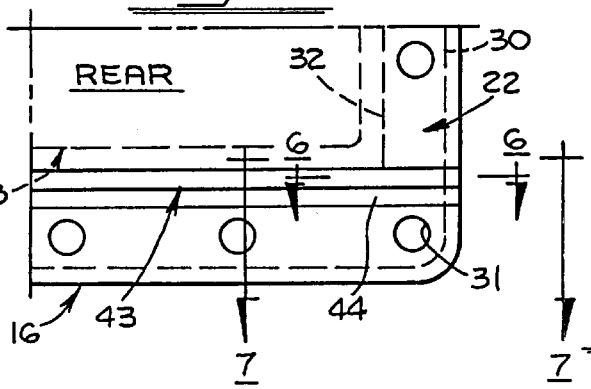
FIG. 2 is a fragmentary view of the rear side of the device.
Figure 3:
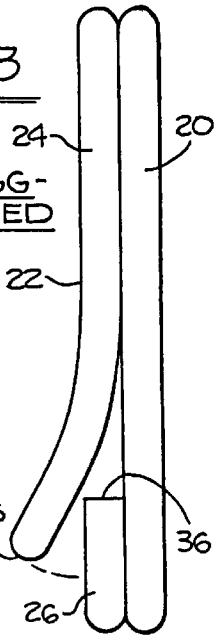
FIG. 3 is an edge view, taken at line 3—3 of FIG. 1.
Figure 4:
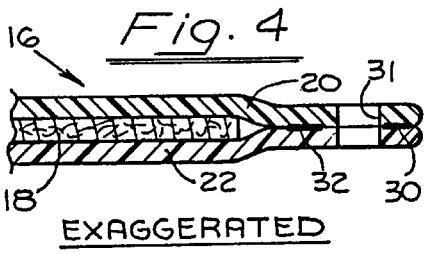
FIG. 4 is a large scale view taken at line 4—4 of FIG. 1.

Referring in detail to the drawings, attention is directed first to FIGS. 1–3 showing the overall device in general views. The elements making up the sign are extremely thin, and therefore some of the figures are exaggerated in thickness relative to the actual appearance of the elements in the finished physical device. The sign includes an envelope 16 and a sign 18 (see also FIG. 8). For convenience the entire article will be referred to as the sign and the sign per se 18 as the sign element. A tie 19 of known kind is utilized for mounting the sign.

The envelope 16 is made up nearly entirely of clear or colored transparent plastic, and the sign element 18 of a desired material, such as paper or cardboard. The sign element may be colored, or white, or even transparent with opaque lettering.

The envelope includes a front panel 20 and a back panel 22. The front panel 20 is constituted by a single piece of plastic, while the back panel 22 includes an upper section 24 and a lower section 26. At the present, while the back panel is made up of two sections, it will be referred to at times as a single member in describing the overall envelope. For convenience the sign is referred to having a top edge 27, bottom edge 28, and end edges 29, and the device will be described as so oriented, although it may be mounted in any of various orientations.

The two panels, front and back, are sealed together around their periphery as indicated at 30 by a known means in sealing plastic. This line of sealing is referred to as an outer sealing line.

Inwardly of the outer sealing line 30 is a series of holes 31, spaced apart a suitable distance, such as 1" to 2", these holes forming a peripheral line around the device, on all sides thereof, and are used for threading ties therethrough as referred to below.

Inwardly of the peripheral lines of holes 31, is another sealing line 32, referred to an inner sealing line. The holes 31 are cut through both front and back panels, and hence the inner sealing line forms an inner space 34 (FIG. 8) for receiving the sign element. Weather and other outside elements are prevented by the inner sealing line from passing into the spaces between the front and back panels through the holes 31.

Reference is now made to the construction of the back panel 22. The upper section 24 of the back panel (FIG. 3) extends from the upper edge of the device down to nearly the lower edge as indicated at 35 (FIG. 3), and the lower section 26 is relatively narrow in vertical direction, and also extends the full length of the envelope. The lower section is shown as having an upper edge 36, which is overlapped by the upper section.

While the two panels are sealed together entirely around the envelope, the top edge and end edges form permanent sealing against the interior of the envelope, but along the bottom edge or bottom portion of the envelope, the panels are arranged for insertion or removal of the sign element. For this feature attention is directed to FIGS. 3 and 5. The lower section 26 is held by the outer and inner sealing lines 30, 32 (FIG. 5) and the upper edge of this lower section, and the lower edge of the upper section, between the ends, are free of attachment to the front panel as indicated at 38.

Figure 5:
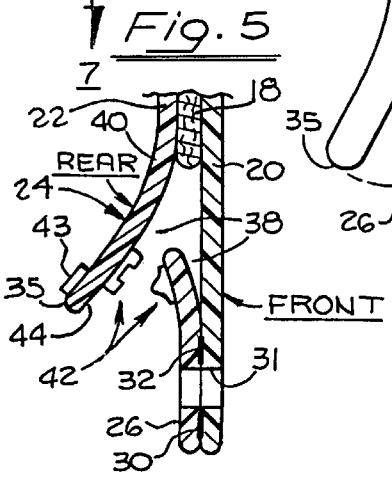
FIG. 5 is a sectional view taken at line 5—5 of FIG. 1.

The free edges of the sections of the back panel can be flexed outwardly, while their end edges remain sealed to the front panel. FIG. 5 shows the edge portions so flexed outwardly, and attention is directed also to FIG. 8 which shows the envelope in inverted position and the edge portion 35, which constitutes a flap, opened out to a much wider extent. In so opening up this flap 35, the entire envelope can be bent around a vertical axis to facilitate that step.

Sealing zipper means 42 (FIG. 5) is provided to releasably secure the overlapping sections of the back panel together. This sealing zipper means is of known type, and is constituted by a pair of strips of clear plastic, one having a groove and the other a pointed insert. The edges forming the groove are flexible outwardly to receive the insert on the other counter part. This zipper means is moisture tight.

When the two portions of the sections of the back panel are connected together by the zipper means, the back panel assumes a position nearly straight (FIG. 3) although there is of course a certain thickness developed by the overlapping. However in practical use the added thickness is very slight.

To facilitate the user in handling the device, a visual signal means is provided, which is in the form of a colored plastic strip 43 (FIGS. 2, 5) which is secured to the lower edge of the upper section and extends the full length of the envelope.

Preferably the zipper means (FIG. 5) is positioned above the lower edge 35 of the upper section, so as to form a flap 44, which extends free of the other elements, enabling the user to grip it and pull the upper section free of the lower section, the visual strip 43 being positioned on this flap to facilitate observing of the location of the flap.

The visual indicator strip 43 (FIG. 6) is extended fully to the ends of the envelope, and sealed in the envelope in the outer sealing line 30.

In a similar manner, the zipper means 42 (FIG. 7) is sealed in the outer sealing line 30, between the front and back panel.

Figure 6:
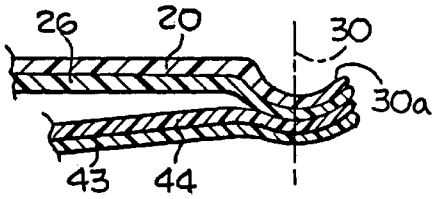
FIG. 6 is a sectional view taken at line 6—6 of FIG. 2.
Figure 7:
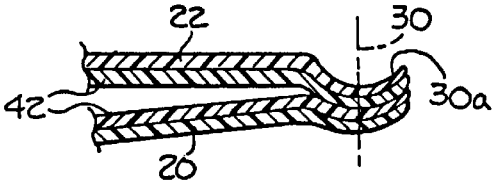
FIG. 7 is a sectional view taken at line 7—7 of FIG. 2.

In FIGS. 6 and 7 the sealing line 30 is indicated diagrammatically, and a highly exaggerated depression 30*a* represents the actual sealing area.

Figure 8:
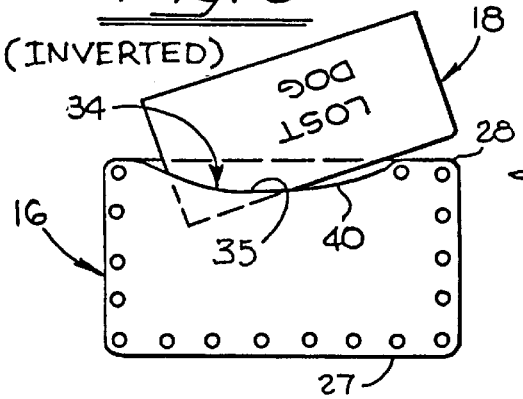
FIG. 8 is a face view of the envelope and a sign per se in a step of inserting the sign into the envelope, both being shown in inverted position.
Figure 9:
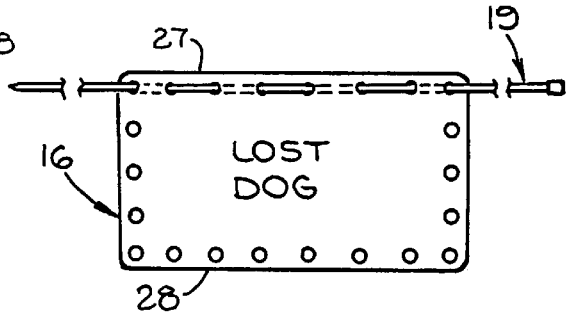
FIG. 9 is a view of the device, showing the sign within the envelope and exposed through the transparent envelope.

Attention is directed to FIGS. 8 and 9 showing the manner in which the sign element is put into the envelope, and the sign made ready for mounting. In FIG. 8 the envelope is shown inverted relative to that of FIG. 1, to place the opening at the top for convenience. The sign element 18 is shown partially inserted into the envelope, also in inverted position. After the sign element is so inserted, the zipper means 42 is closed, sealing the envelope and thus the sign element is completely covered. FIG. 9 shows the device inverted again to upright position, and the tie 19 inserted through the holes along the top edge of the envelope, for mounting purposes. The panels, as noted above, are transparent, and preferably clear, although they may be colored, and the inscriptions on the sign element show therethrough readily, as indicated in FIG. 9.

Figure 10:
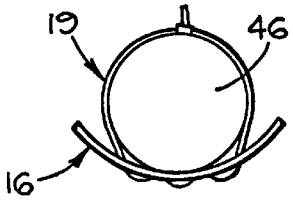
FIG. 10 is a top view showing the sign mounted on a round post.

Attention is directed to FIGS. 10–13 showing the mounting of the sign in different ways. In so mounting the sign, reference is again made to the fact that a great advantage of the device is that it can be readily mounted on various instrumentalities that are already in place such as on a post, a fence, etc. It is not necessary to provide a special mounting means, such as a stake, for mounting the sign. FIG. 10 shows the sign 16 mounted on a round post 46, with the tie 19 inserted through certain of the holes 31 and tied around the post.

Figure 11:
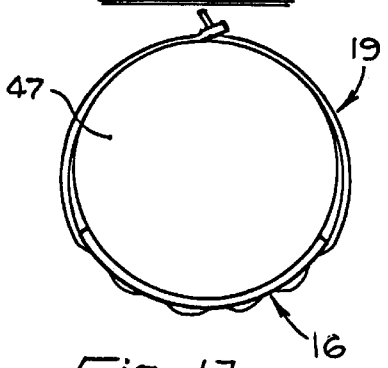
FIG. 11 is a top view showing the device mounted on a tree.

The sign is basically quite flexible transversely so as to be adapted to various shapes of mounting means. However it does have a certain degree of rigidity, such that when it is mounted on a small mounting means such as the post of FIG. 10, where the tie is put through holes 31 that are spaced inwardly from the ends of the sign, the extended ends of the sign then remain extended outwardly somewhat to avoid a complete curve shape, to facilitate reading the sign. FIG. 11 shows the sign can easily be applied to a tree 47. If the tie 19 provided with the sign is too short for the purpose, any kind of string or twine may be used instead, providing a further advantage in that the sign can be easily mounted.

Figure 12:
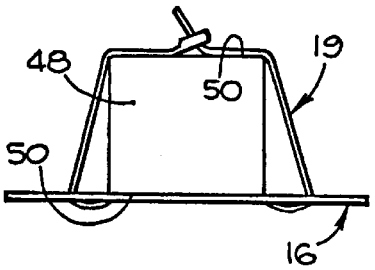
FIG. 12 is a top view showing the device mounted on a square post.

Attention is directed to FIG. 12 showing the sign mounted on a square post 48, having a flat front surface 50. In this case such a post is ordinarily rather narrow, and the sign would extend in horizontal direction beyond the dimensions of the post, as in the case of FIG. 10, and the tie may be inserted in the holes spaced inwardly from the ends of the sign and wrapped on the post. In this case, the limited rigidity of the sign tends to hold the sign at least nearly flat, to facilitate reading of it.

Figure 13:
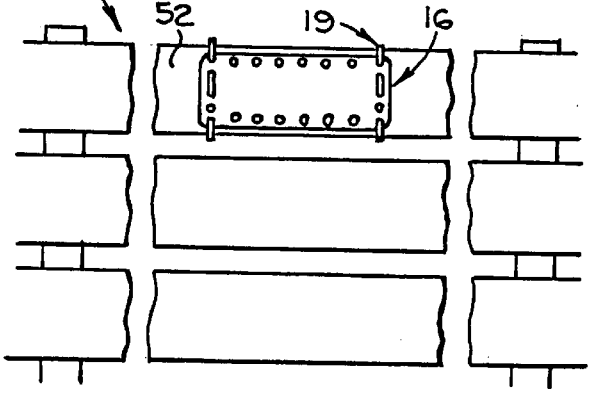
FIG. 13 shows the device mounted on a board fence.

While in many cases, in mounting the sign as described above, the tie would be threaded through the upper and lower lines of holes, an advantage of the present device resides also in the holes in the end edges of the sign, which are arranged in vertical rows. FIG. 13 shows the sign mounted on a board fence 51 having horizontal boards 52, and the ties 19 are threaded through the holes at the ends of the sign, and thus in vertical position, for tying around the horizontal board.

The provision of the holes at both top and bottom, and at the ends, enables using ties at both of either pair of opposite sides, for more complete securement.

Many of the details referred to herein are given as examples, and the invention is of such scope to encompass many variations thereof.

I claim:

1. A reusable weather-proof sign cover, comprising, an envelope including transparent plastic front and back panels, said panels having surrounding edges forming a common border of the envelope, the panels being sealed together around said common border in an outer sealing line, the envelope having a peripheral line of spaced holes through both panels, inwardly of the outer sealing line, and adapted to receive a mounting tie, the panels also being sealed together in an inner sealing line, inwardly of the line of holes, and the back panel being made up of an upper and a lower section, the upper section having a lower edge and the lower section having an upper edge, and the lower edge of the upper section overlapping the upper edge of the lower section.

2. A sign cover according to claim 1 wherein, the envelope also has end edges, and both sections of the back panel are sealed to the front panel throughout the length of the end edges of the envelope.

3. A sign cover according to claim 2 wherein, the overlapping edges of the sections of the back panel have sealing releasable fastening means thereon extending the full length of said overlapping edges, and sealed between the end edges of the panels in said outer sealing line.

4. A sign cover according to claim 1 wherein, the lower edge of the upper section of the back panel forms a tab for manual grasping by a user for releasing the fastening means, and has a visual marker thereon extending the full length of the lower section of the back panel and sealed in said outer sealing line.

5. A sign cover according to claim 1 wherein, the plastic is flexible, but possesses a limited degree of rigidity effective for holding the envelope relatively straight when the sign cover is mountedly secured at locations spaced inwardly from opposite edges thereof.

6. A sign cover in combination with a mounting tie comprising said mounting tie, and an envelope including transparent plastic front and back panels, said panels having surrounding edges forming a common border of the envelope, the panels being sealed together around said common border in an outer sealing line, the envelope having a peripheral line of spaced holes through both panels, inwardly of the outer sealing line, and adapted to receive said mounting tie, the panels also being sealed together in an inner sealing line, inwardly of the line of holes, and the back panel being made up of an upper and a lower section, the upper section having a lower edge and the lower section having an upper edge, and the lower edge of the upper section overlapping the upper edge of the lower section.

7. A sign cover in combination with a sign comprising said sign, and an envelope including transparent plastic front and back panels, said panels having surrounding edges forming a common border of the envelope, the panels being sealed together around said common border in an outer sealing line, the envelope having a peripheral line of spaced holes through both panels, inwardly of the outer sealing line, and adapted to receive a mounting tie, the panels also being sealed together in an inner sealing line, inwardly of the line of holes, and the back panel being made up of an upper and a lower section, the upper section having a lower edge and the lower section having an upper edge, and the lower edge of the upper section overlapping the upper edge of the lower section.

* * * * *